US005187899A

United States Patent [19]

Rhoades

[11] Patent Number: 5,187,899

[45] Date of Patent: Feb. 23, 1993

[54] HIGH FREQUENCY VIBRATIONAL POLISHING

[75] Inventor: Lawrence J. Rhoades, Pittsburgh, Pa.

[73] Assignee: Extrude Hone Corporation, Irwin, Pa.

[21] Appl. No.: 454,290

[22] Filed: Dec. 21, 1989

Related U.S. Application Data

[63] Continuation-in-part of Ser. No. 305,768, Feb. 3, 1989, abandoned, which is a continuation-in-part of Ser. No. 166,502, Mar. 10, 1988, abandoned, which is a continuation of Ser. No. 928,355, Nov. 10, 1986, abandoned.

[51] Int. Cl.[5] ..... B24B 1/04

[52] U.S. Cl. ..... 51/59 SS; 51/317

[58] Field of Search ..... 51/59 SS, 317, 157, 51/281 R

[56] References Cited

U.S. PATENT DOCUMENTS

| | | | |
|---|---|---|---|
| 2,774,193 | 12/1956 | Thatcher et al. | 51/317 |
| 2,804,724 | 9/1957 | Thatcher | 51/317 |
| 2,850,854 | 9/1958 | Levy | 51/317 |
| 3,593,410 | 7/1971 | Taylor | 51/317 |
| 4,071,385 | 1/1978 | Kuris | 51/59 SS |
| 4,100,701 | 7/1978 | Bessaguet | 51/281 R |
| 4,497,101 | 2/1985 | Schrader | 51/281 R |

FOREIGN PATENT DOCUMENTS

| | | | |
|---|---|---|---|
| 133697 | 10/1979 | Japan | 51/59 SS |

*Primary Examiner*—Robert A. Rose
*Attorney, Agent, or Firm*—Waldron & Associates

[57] ABSTRACT

High frequency vibrational polishing without substantial loss of fine resolution and detail is provided by employing a tool of a more ultrasonically abradable material than the workpiece, as the oscillating driver of a liquid abrasive slurry. The total is preferentially eroded and conforms to the pattern of the workpiece continuously self-dressing during polishing.

19 Claims, No Drawings

HIGH FREQUENCY VIBRATIONAL POLISHING

REFERENCE TO RELATED APPLICATIONS

This is a Continuation-In-Part Application of application Ser. No. 305,768, filed Feb. 3, 1989, now abandoned, which was a Continuation-In-Part Application of application Ser. No. 166,502, filed Mar. 10, 1988, now abandoned, which was a Continuation Application of application Ser. No. 928,355, filed Nov. 10, 1986, and now abandoned.

BACKGROUND OF THE INVENTION

1. Field of the Invention

The present invention relates to the polishing of hard materials such as metals and the like by means of high frequency vibrational oscillatory vibrations. More particularly, this invention relates to the polishing of the surface of a workpiece by means of a comparatively more vibrationally abradable tool oscillated at frequencies above 1 KHz which, during polishing, develops a form which is a complement of the form of the surface of the workpiece. The oscillatory vibrations of the tool are imparted to a liquid abrasive slurry disposed between the tool and workpiece which abrades the tool to conform to the configuration of the workpiece and at the same time polishes the configuration of the workpiece.

The present invention is particularly adapted to polishing of already formed compound surfaces and complex shapes having fine or intricate detail where a reduction in surface roughness is needed without loss of the existing resolution and detail.

2. Summary of the Prior Art

There are may prior art processes for the polishing of workpiece surfaces, including both traditional and nontraditional processes. Of the non-traditional processes, "superfininshing", "Diprofil" ultrasonic polishing and ultrasonic polishing are perhaps the most common. In the "superfinishing" process, a workpiece is rotated in direct contact with a reciprocating tool, the tool consisting of abrasive particles in a relatively soft binder, so that the rotating workpiece will shape the tool which in turn polishes the workpiece during periods of direct contact therebetween. High frequency vibrations are not involved in this process.

The "Diprofil" polishing process (marketed by the Elgin Corporation, Morton Grove, Ill.) involves the use of a hand held tool having a small abrasive pad at the end of a narrow probe which vibrates at ultrasonic frequencies. In this process, selected surfaces of a workpiece can be manually polished by choosing a tool insert, i.e. pad, which reasonable matches the surface to be posished.

Ultrasonic machining and polishing are well known machining processes whereby the surface of a workpiece is abraded by a grit contained in a slurry circulated between the workpiece surface and a vibrating tool adjacent thereto, with the tool typically vibrating at frequencies above the audible range, i.e. usually within the range of 19,500 to 20,500 cycles per second. The amplitude of vibration is normally less than 0.1 mm (0.004 inch), and typically within the range 0.01 to 0.05 mm (0.0004 to 0.002 inch). Normally, the frequency and amplitude are inversely proportional so that the higher the frequency, the lower the amplitude.

In conventional ultrasonic machining, the abrading tool face is provided with a three-dimensional form, so that a negative complement thereof is machined onto the workpiece surface. Since the tool itself does not contact the workpiece, the actual cutting or abrasion is done by the abrasive particles suspended in the slurry which are caused to impinge against the workpiece surface by the oscillatory vibration of the tool. These particles are driven with a percussive impact against the workpiece surface by the tool, generally vibrating perpendicular to the workpiece surface. The vibrational frequency of the abrasive particles is somewhat less than that of the tool.

It has always been considered as essential in ultrasonic machining that the tool be abraded to the minimum extent possible to thereby extend its service life. Accordingly, tools for this process have typically been made of a material having high strength and good ductility, in order to impart a high degree of impact resistance to the abrading particles and thereby minimize abrasion of the tool itself.

Ultrasonic machining finds particular utility in its ability to work materials which are difficult to abrade such as glass, ceramics, calcined or vitrified refractory materials and hard and/or brittle metals, which are not susceptible to machining by any other traditional technique, or even such nontraditional techniques such as electrical discharge machining, electrochemical machining or the like. Indeed, such materials are more abradable in ultrasonic machining and other comparable processes than are those materials which are easily machined by traditional machining processes. Ultrasonic machining has proven particularly advantageous for reproducing complex shapes which could not be obtained by traditional machining, or even by nontraditional techniques such as electrical discharge machining, electrochemical machining, or the like because of the nature of the materials to be worked.

It is recognized, of course, that ultrasonic machining will impart some abrasive erosion to the tool as well as the workpiece, so that there is an ongoing and increasing loss of fine detail and resolution as the tool is used and worn. Since it is further obvious that the resolution and detail of the image formed into the surface of the workpiece can be no better than that of the tool, it has been considered rather important that the tool material be one that is comparatively tough and ductile, i.e. not readily abradable by the machining action of the vibrating particles, so as that the tool will be abraded to a much lesser degree than the workpiece. For example, tools are commonly made of materials such as titanium, nickel, austenitic stainless steel, cold rolled steel, copper, aluminum and the like which are abraded to a significantly lesser degree than the normally brittle workpiece materials to which the process is appled. Once the tool has been abraded to the degree that the machined surface in the workpiece no longer meets the desired resolution and detail, it is necessary to replace the tool with a new one, or in the alternative redress and reform the image on the tool by such techniques as EDM or the like by which the tool material is more readily machined.

In addition to the above, ultrasonic machining in its normal practice, only abrades areas of the workpiece which are most adjacent to the tool face surfaces, and accordingly, the gap between the tool and workpiece must be very carefully regulated to be as uniform as possible across the entire work surface. Therefore, if ultrasonic machining is to be used on a workpiece that is already formed, or formed in part, as in a polishing operation, it is very important that the tool and workpiece be aligned and registered as accurately as possible. Otherwise, the workpiece will be abraded or polished nonuniformly and possibly even destroyed by the abrasion action. Setting-up the tool and workpiece with the necessarily accurate indexing and registration is a time consuming and laborious procedure as even a very slight misalignment or misregistration can have significant adverse effects on the workpiece being machined or polished.

The foregoing limitations and difficulties have been significant enough to cause operators to choose other machining techniques when the nature of the materials to be worked permit, and has generally required the use of other techniques for polishing operations in particular. Any of the polishing techniques in common use are historically labor intensive, time consuming and expensive operations, and in addition typically require skilled workers and often produce rather inconsistent results. Ultrasonic polishing has been even more demanding in these regards. Polishing by any method requires the removal of a very small amount of workpiece material, and ideally a very uniform removal thereof. Manual polishing, vibratory finishing, buffing, brushing and even extrusion honing cannot remove the workpiece material to the extent of uniformity often desired, particularly in the case of cavities within complex workpiece surfaces. While ultrasonic polishing is capable of removing a very uniform surface layer from the workpiece, this can be done only by assuring a very exacting tool image configuration, by the labor intensive efforts of exact indexing and registration, and the costly frequent tool replacement or redressing.

OBJECTS OF THE INVENTION

It is accordingly an object of the present invention to provide a new and improved method for polishing which removes a very small and very uniform layer from the workpiece surface with a far greater extent of uniformity than is possible with other known polishing operations.

It is another object of this invention to provide a new and improved method of polishing which does not require any indexing or registration of the tool to the workpiece.

It is a further object of the present invention to provide a polishing method which removes a thin and very uniform layer of workpiece material and does not require the use of a preformed tool and therefore, does not involve any indexing and registration of the tool and workpiece.

In addition, it is a further object of this invention to provide a new and improved method for polishing which is suitable for use with substantially all machinable materials and which is effective at obtaining a high surface polish without the loss of resolution or detail.

It is still another object of this invention to provide a method of removing an undesirable layer of material from a workpiece surface such as a recast layer, or to remove burrs or to radius the edges of a workpiece.

SUMMARY OF THE INVENTION

According to the present invention, there is provided a method for high frequency vibrational polishing (i.e. sonic or ultrasonic) of a workpiece by means of a tool which is significantly more vibrationally abradable than the workpiece and therefore, need not be preformed to provide a complement of the surface of the workpiece. Instead, a blank tool face can be used. When the tool is vibrated, imparting its vibrations to an abrasive slurry disposed in the gap between the tool and workpiece, the tool is quickly eroded in such a fashion that it quickly develops a complementary form of the workpiece with a high degree of resolution and detail. Thereafter, the tool will continue to be abraded at a comparatively high rate while continuing to maintain its high degree of resolution and detail. At the same time, the surface of the workpiece is abraded to a much lesser degree so that in effect, it is merely polished while the tool is being progressively abraded down, but at all times maintaining its high resolution and detailed complementary work surface.

The present invention may be employed to polish any material more resistant to vibrational (sonic and ultrasonic) erosion than the material of which the tool is made. In this fashion, the tool will be re-dressed continuously and inherently to the complementary form of the workpiece, by virtue of the fact that the tool will be eroded to a greater extent than the workpiece. The preferential working of the tool results in a constant or even increasing conformity to the fine detail and resolution of the workpiece, so that as polishing of the workpiece occurs, there is no loss of resolution.

By the present technique, vibrational polishing is made applicable even to relatively soft and easy to work materials, such as bronze, brass, or gold, to polymeric materials, and a wide diversity of other materials which were not heretofore thought to be appropriate for ultrasonic polishing techniques, in addition to very much harder materials, including those where ultrasonic machining techniques have been employed previously, as discussed above.

With vibrational polishing in accordance with the present invention, surface finishes can be attained, depending on the extent of polishing, of substantially any desired degree, regardless of the material and in any degree of intricacy and fineness of detail without substantial change in detail or resolution. Surface roughness can be reduced to as low as about 0.1 microns Ra, although such high degree of polish may not always be required and a lesser extent of polishing may often suffice for a given application.

Because the process of this invention does remove a very uniform layer of material from a workpiece surface, the process is also ideally suited to the removal of thin layers of unwanted material from a workpiece surface, such as an EDM recast layer of material which is normally 0.003 to 0.06 mm (0.0001 to 0.002 inch) thick. In addition, the process of this invention can be used to remove burrs from a workpiece surface or to radius the edges thereof.

DETAILED DESCRIPTION OF THE INVENTION

Ultrasonic machine tools are known to the art and the present invention is generally applicable for use with such machines, utilizing typical parameters for vibrational frequency, amplitude and abrading particles, and including sonic vibrational frequencies which may be as low as 1 KHz. Typically, such equipment comprises a frame adapted to hold a workpiece and a tool holder including an ultrasonic driver which vibrates the tool at a frequency of about 20 KHz up to, in some applications, 40 KHz. Most often, however, ultrasonic machining and polishing are effected at vibrational frequencies of about 19 to 22 KHz. The tool holder is adapted to advance the tool from a retracted position into a working position spaced from the workpiece, and during the working operation, slowly advance the tool or workpiece to maintain a constant gap. The equipment will ordinarily be furnished with abrasive slurry handling means so that the slurry can be disposed between the tool and the workpiece. The slurry will often be pumped through the gap between the tool and workpiece to continuously provide fresh, unworn abrasive to the working surface and to flush away eroded material and debris. The slurry may be processed to remove debris and recirculated. The transducer will most typically be an electronically driven stack of piezoelectric elements or a magnetostrictive transducer.

While prior art ultrasonic machining and polishing has normally been effected at frequencies of 19 to 22 KHz, as noted above, it has been found that the polishing process of this invention is suited to use frequencies well below that range, and down to frequencies as low as 1 KHz. Although frequencies within the range 10 to 18 KHz are preferred, any frequency within the broad range of 1 to 40 KHz can be used effectively. It would follow therefore, that the process of this invention cannot properly be termed as an ultrasonic polishing process, as frequencies well below the ultrasonic range can be utilized. For lack of better terminology, therefore, the process herein is referred to as a high frequency vibrational polishing process.

The abrasive slurry will ordinarily be formed of hard abrasive particles disposed in a liquid carrier. The abrasives are typically silicon carbide, aluminum oxide, boron carbide, boron nitride, diamond and the like, although it should be noted that when polishing softer materials by the present invention, softer abrasives may be used, such as alumina, corundum, garnet, and the like. The liquid carrier must be one capable of transmitting sonic and ultrasonic vibrations and should be chosen to be compatible with the workpiece and the electrode materials. Water is the best such transmitter, although other liquids such as cutting oil or fluid and the like may be used. When water is used, it may be necessary to add rust inhibitors. In polishing operations according to this invention, as opposed to machining according to the prior art, a relatively modest movement of the abrasive particles is preferred. Therefore, liquids other than water, such as cutting oil, can be used to effect a low amplitude particle movement, or in the alternative a lower power can be used with the water as the transmitter. Additionally, as already noted, ultrasonic vibrational frequencies are not essential, as frequencies below 10 KHz have shown to be satisfactory.

Generally, the particle size of the abrasive is not particularly critical as long as the particle size is such that it can be held in suspension. It has been found, however, that a reasonable degree of uniformity of particle size is preferred, and, not surprisingly, finer particles will effect finer surfaces finishes. It is generally preferred, therefore, to use small particle sizes, less than 200 mesh, and preferably, 320 to 1000 mesh, with a particle concentration of from 25 to 50 volume percent of the fluid to attain the highest levels of polish.

The workpiece to be polished can be substantially any material which, contrary to prior art practices, is sonically or ultrasonically less susceptible to abrasion than the tool material, typically, a metallic workpiece. The extent of polishing required will be determined by the initial surface roughness of the workpiece and the finish required after polishing. Both an advantage and a limitation of the procedure of the present invention resides in the fact that the configuration of the workpiece will not be appreciably altered during the polishing operation. It is thus important to recognize that the present invention will not improve resolution of fine detail, and the quality of the final product will, except for surface finish, be determined by the initial workpiece.

The tool, as previously noted, must be formed of a material that is considerably more abradable in the process than the workpiece material. A more abradable material in this process does not mean one that is softer, or more abradable in the general sense, but one that is more abradable in conventional ultrasonic machining processes. Such materials are typically rather brittle, and may even be harder than those considered less abradable. To understand ultrasonic abradability, it should be realized that in the ultrasonic machining of a surface, the tiny abrasive particles suspended in the fluid are propelled by the vibrational motion of the tool and caused to be impinged against the workpiece surface at a velocity typically about 3 feet per second, so that the tiny particles microscopically chip-away at the workpiece surface. Workpiece materials with some degree of brittleness, whether or not the material is hard, are more readily machined and abraded by this chipping action. It should be apparent that soft or resilient materials such as tough and ductile steels could not be readily machined in this fashion because the tiny abrasive particles have a greater tendency to merely bounce therefrom. Accordingly, for the polishing of most metal workpieces in accordance with the process of this invention, which would include everything from mild steel to hardened alloys and refractory metals such as titanium and tungsten, an ideal tool material would be a material having a significantly greater degree of ultrasonic abradability, such as graphite, glass, quartz and other such materials which have normally been considered ideal workpiece materials but not tool materials. The relative relationships of ultrasonic abradability of the various materials is well known in the art, and therefore, need not be detailed here.

It should be noted, however, that since the process of this invention contemplates the use of sonic as well as ultrasonic frequencies, that there is no practical difference between ultrasonic abradability and sonic abradability. Accordingly, the term "ultrasonically abradable" as used herein is used with reference to the comparative abradability of materials with reference to conventional ultrasonic machining, which is well known in the art, with the understanding that the same comparative relationship will hold true whether one in using ultrasonic of sonic frequencies. Hence a material that is more ultrasonically abradable than another, will be more abradable in the process of this invention regardless of the frequency employed, be it sonic or ultrasonic. Hence any reference to "sonic" abradability has been avoided as it could cause some confusion by suggesting that there could be a difference between sonic and ultrasonic abradability.

When employed with suitable equipment, the tool may be provided with passages communicating with the gap through which the abrasive slurry may be pumped to provide flushing of debris from the gap. In the present invention, the debris will predominantly be tool material particles eroded from the tool combined with minor amounts of material polished from the surfaces of the workpiece. In addition, the pumping will serve to provide fresh abrasive slurry to the gap so that cutting edges are not excessively worn during use.

Contrary to prior art practices, it is not necessary to start the polishing process of this invention with a pre-shaped tool, and accordingly, indexing and registration of the tool and workpiece are not required. As has been previously noted, all prior art techniques for ultrasonic polishing have utilized a preformed tool so that exacting degrees of indexing and registration have always been necessary. In the process of this invention, however, the starting tool is not preshaped or only partially pre-shaped so that the surface contour of the workpiece first serves to shape the tool surface into very exact registration therewith. During the subsequent polishing operation, the tool is continually eroded and will perpetually generate and maintain very exact registration in situ. The preferential erosion of the tool is the unique feature of the present invention which permits a high polish on the workpiece surface by a very thin, highly uniform surface removal. In some applications, particularly where the surface to be polished has deeply recessed portions, it may be desirable to utilize a pre-shaped or partially pre-shaped tool to speed up the operation by minimizing the amount of time it takes to shape the tool into registration with the workpiece, and to avoid an excessive polishing action on any highly raised portions of the workpiece surface before the tool is worn sufficiently to start polishing the deeper recessed portions.

It should be recognized that for any given transducer, there is a limit on the mass of any tool that can be successfully driven thereby. The relatively low mass of graphite or glass for examples, in relation to the prior art tool materials most often employed for ultrasonic machining will permit the process of this invention to employ graphite tools of greater dimension than permitted by the prior art practice. Therefore, the process of this invention will permit the polishing of larger workpiece surfaces with a given machine than is possible with prior art techniques. Specifically, to tool is being agraded away in the process, losing volume, and consequently mass, which in turn changes the tool's resonant frequency. Since the most efficient transducers, the piezo electric ones, have a limmitation in their range of efficient resonance, about 2 KHz (19–21 KHz range), use of lighter weight abradable tool materials such as graphite or glass attached to heavier sonotrodes "bodies", such as nickel of steel, permits a greated degree of volumetric tool wear before a new tool assembly is required.

As noted above, the process of this invention is also ideally suited to the removal of any undesired layer of material from a workpiece surface. For example, an EDM recast layer, typically from 0.003 to 0.06 mm (0.0001 to 0.002 inch) thick can readily be removed by the practice of this process with the result that the recast layer is removed without any loss of resolution of detail in the workpiece surface thereunder. In a like manner, workpieces coated with material such as ceramic, can be processed as described herein to remove or selectively remove an abradable coating, such as the ceramic coating, without any loss of dimension on the metallic base workpiece surface. In addition to these variations, the process of this invention can be used to remove burrs which protrude from the workpiece surface, or to radius sharp corners on the edges of the workpiece. Either of these objects can be readily effected by using such an ultrasonically abradable tool without losing workpiece detail.

EXAMPLE

A ½ inch diameter coining die was polished in accordance with the process of this invention, utilizing a graphite tool, a grit of 15 micron silicon carbide and polishing for 15 minutes to remove only 0.0002 inch of material. In addition to the markedly improved surface finish, the edges of the die were also radiused somewhat rounding the right angle corner as resulted from the CNC engraving operation.

What is claimed is:

1. The method of working a workpiece surface having a configuration preformed therein to remove a very thin and uniform layer of material from the workpiece surface without adversely effecting the configuration detail and resolution, the steps comprising:

A. forming a blank tool from a material that is more ultrasonically abradable than the workpiece;

B. mounting said tool in a vibratable relationship to said workpiece;

C. applying a liquid abrasive slurry between said tool and said workpiece;

D. causing a relative vibratory motion between said tool and said workpiece at a frequency and amplitude sufficient to abrade and shape said tool into relative mating conformity with said configuration on the surface of said workpiece;

E. continuing said vibratory motion as will continue to abrade said tool as said tool continues to reform and maintain said relative conformity with the surface configuration of said workpiece while at the same time imparting a relatively minor working action on the surface of said workpiece; and F. stopping said vibratory motion when the surface of the workpiece has been abraded to the degree desired.

2. The method of claim 1 wherein the process is utilized to polish the workpiece surface.

3. The method of claim 1 wherein the process is utilized to remove an unwanted layer of material from the workpiece surface.

4. The method of claim 1 wherein the process is utilized to remove any unwanted burrs from the workpiece surface.

5. The method of claim 1 wherein the process is utilized to radius the edges of the workpiece.

6. The method of claim 1 wherein said vibratory motion is effected at a frequency of from 1 to 40 KHz.

7. The method of claim 1 wherein said tool is preshaped to a form having a general conformance to the preshaped surface of the workpiece.

8. The method of claim 1 wherein the abrasive in said slurry has a particle size less than about 200 mesh.

9. The method of claim 8 wherein said abrasive has a particle size of from 320 to 1000 mesh.

10. The method of claim 8 wherein said abrasive is present in said slurry at a concentration of from 25 to 50 volume percent.

11. The method of claim 1 wherein said tool material is selected from the group consisting of graphite, porous ceramic, glass and quartz.

12. The method of claim 1 wherein said tool material is an unformed block of graphite.

13. The method of claim 1 wherein said tool material is an unformed block of glass.

14. The method of claim 1 wherein said tool material is an unformed block of porous ceramic.

15. The method of claim 1 wherein said liquid abrasive slurry flows continuously through the gap between said tool and said workpiece.

16. The method of claim 1 wherein said liquid abrasive slurry flushes tool particles and particles abraded from said workpiece from said gap.

17. The method of claim 1 wherein said abrasive in said slurry is a member selected from the group consisting of tungsten carbide, aluminum oxide, silicon carbide, boron carbide, boron nitride, alumina, corundum, diamond, and mixtures thereof.

18. The method of claim 1 wherein said workpiece is made of a material not normally considered appropriate for ultrasonic machining.

19. The method of claim 18 wherein said workpiece is made of a material selected from the group consisting of bronze, brass, silver, gold nickel, stainless steel and polymeric materials.

* * * * *